United States Patent [19]

Clarke

[11] Patent Number: 4,773,287

[45] Date of Patent: Sep. 27, 1988

[54] OPEN-ENDED RATCHET WRENCH

[76] Inventor: Roger S. Clarke, 801 Ravenswood Dr., Evansville, Ind. 47713

[21] Appl. No.: 15,670

[22] Filed: Feb. 17, 1987

[51] Int. Cl.[4] ..... B25B 13/00

[52] U.S. Cl. ..... 81/90.2; 81/97

[58] Field of Search ..... 81/92, 97, 98, 99, 90.1, 81/90.2, 91.2, 111, 94

[56] References Cited

U.S. PATENT DOCUMENTS

| | | | |
|---|---|---|---|
| 1,072,090 | 9/1913 | Cook | 81/99 |
| 1,183,371 | 5/1916 | Ginsburg | 81/90.2 |
| 1,406,910 | 2/1922 | Sutherland | 81/99 |
| 1,718,719 | 6/1929 | Turner | 81/90.2 |
| 2,537,838 | 1/1951 | Logan | 81/90.2 |
| 3,937,550 | 5/1960 | Milentz | 81/90.2 |

*Primary Examiner*—Frederick R. Schmidt

*Assistant Examiner*—Bradley I. Vaught

*Attorney, Agent, or Firm*—Warren D. Flackbert

[57] ABSTRACT

An open-ended ratchet wrench characterized by a handle pivotally carrying a stationary jaw, with a toggle jaw pivotally secured to the latter. The handle includes a cam at the jaw mounting end thereof which presents camming surfaces selectively functional at operative conditions of the wrench. In this regard, one camming surface in combination with the pivotal jaw provides maximum force power during one operative condition, while another cam surface cooperates with the stationary jaw in a stop relationship. A feature of the invention is the ready sliding placement thereof into a workpiece engaging condition, where tightening and untightening of the workpiece is achieved by inverting the wrench 180°.

11 Claims, 1 Drawing Sheet

OPEN-ENDED RATCHET WRENCH

As is known, the need for a wrench, as a tool, is widespread, accomplishing many tasks. In addition to the commonly known box wrench, a more sophisticated tool is presented by an open ended ratchet wrench, either single or double-ended, which serves particularized tightening and/or loosening operations, as, for example, where usable and/or available space is at a premium.

Although various open-ended ratchet wrenches are commercially available, the present invention provides important features, including, and by way of example, the employment of stop and toggling mechanisms which are virtually sealed from exposure to outside contaminants; a particular tooth arrangement modified from the standard box wrench configuration so as to aid in releasing the workpiece at the time of acquiring a new bite; and, the availability of workpiece entry into the jaws when the latter are in a fully closed position, i.e. without the jaws being caused to spread. The latter is accomplished by a heavy duty stop which limits closure and, as well, a snub nose arrangement which does not wrap around the workpiece when it is across the workpiece flats and yet incorporates a 30° increment advancing feature not available in prior structures.

Figure 1:
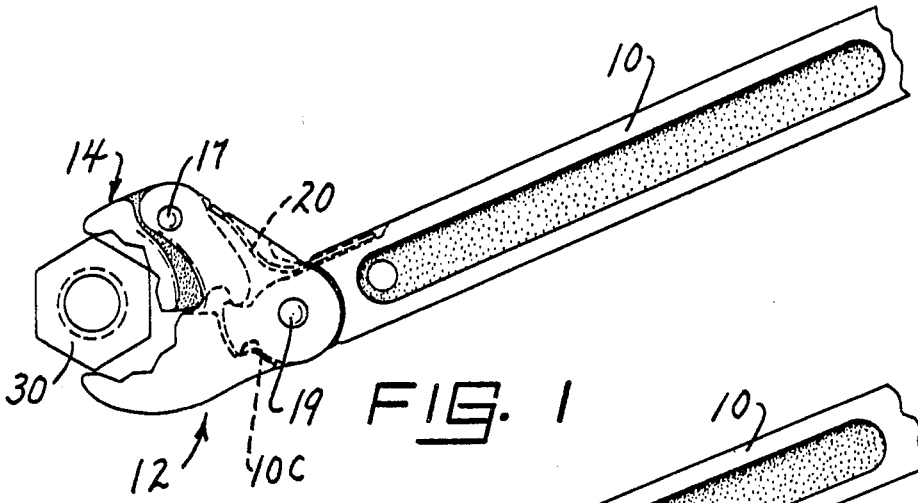
Figure 2:
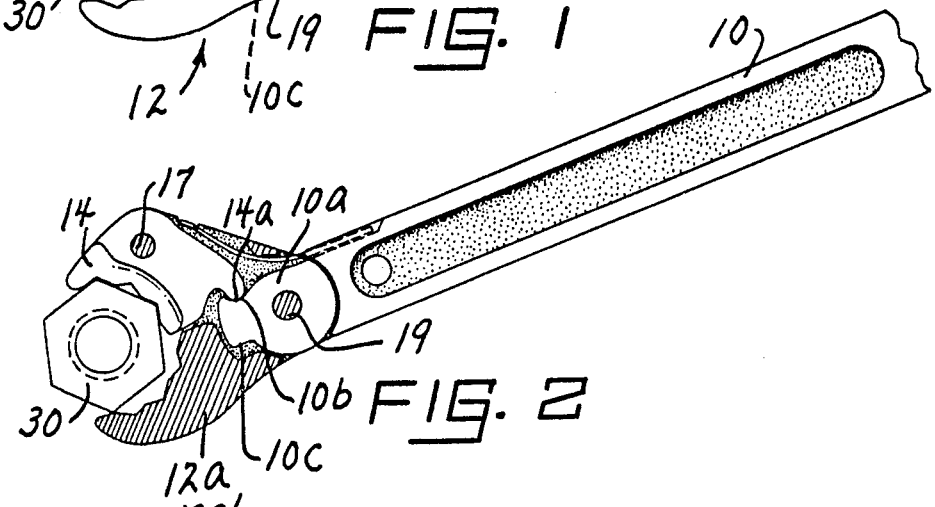
Figure 3:
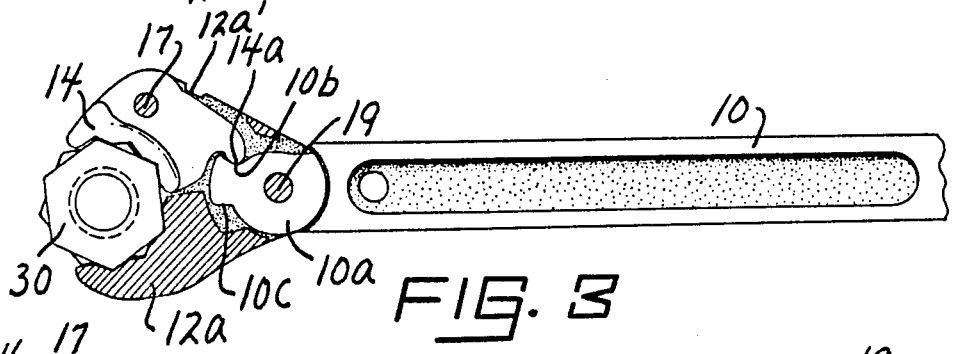
Figure 4:
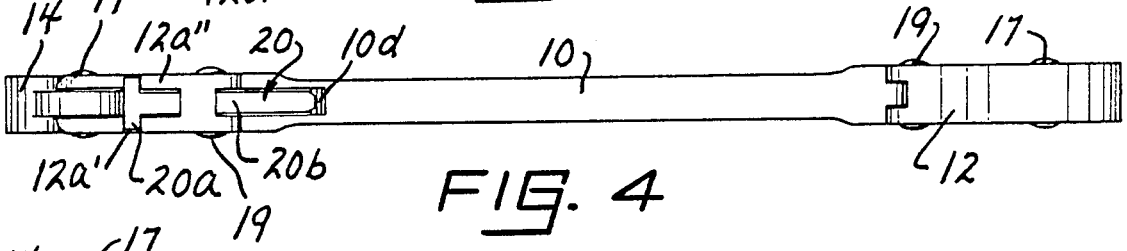
Figure 5:
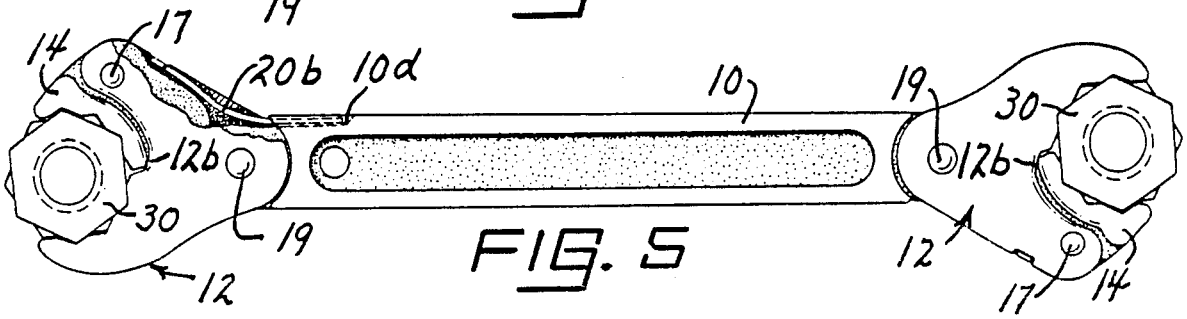

The preceding are representative, where a better understanding of the present invention will become more apparent from the following description, taken in conjunction with the accompanying drawing, wherein FIG. 1 is a view in side elevation showing an open ended ratchet wrench in accordance with the teachings of the invention accessing the workpiece from the side in a representative maximum opening condition which allows access over opposite apexes by applying pressure to the workpiece with the small wrench jaw only;

FIG. 2 is another view in side elevation of the instant open-ended ratchet wrench, comparing to that of FIG. 1, but partially in section, and revealing the wrench in an intermediate position of advancement on the workpiece;

FIG. 3 is yet another view in side elevation, also partially in section, further detailing the wrench at a subsequent use condition of enveloping the workpiece in either of two possible positions, namely, across the apexes (peaks) or across the flats, since the wrench can access both positions from the end of the workpiece and can access the workpiece across the flats from the side without spreading the jaws;

FIG. 4 is a top plane view of the instant open-ended wrench, looking downwardly onto FIG. 5; and, FIG. 5 is a view in side elevation of a double-headed open-ended ratchet wrench in accordance with the teachings of the invention.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to the figures, the open-ended ratchet wrench of the invention is defined by a handle 10; a large jaw 12; a small jaw 14 (where large jaw 12 and small jaw 14 are in a selective cooperable engagement with a workpiece 30); pins 17 and 19; and, a spring member 20 (in a preferred invention form). It should be noted that the aforesaid components are in close proximity to an end of the wrench, making such suitable for double-ended usage (see FIGS. 4 and 5).

Small jaw 14 is operable, at pin 17, between sides 12*a* of large jaw 12 (see FIGS. 4 and 5). Handle 10 includes a cam 10*a* at one end, pivotal at pin 19 to large jaw 12, and presenting camming surface 10*b* and handle cam stop 10*c*. As also evident in FIGS. 2 and 3, camming surface 10*b* engages a corresponding or cooperating camming surface 14*a* on the small jaw 14 approximately along an in-line relationship between pins 17 and 19. The in-line relationship results, when in use, for a maximum amount of force transfer, i.e. as when the handle 10 is moved in a clockwise or workpiece 30 tightening direction in FIGS. 3 and 5.

When in a workpiece 30 release condition, as when the handle 10 is moved oppositely or in a counterclockwise direction (see FIG. 2) prior to further workpiece 30 tightening, the small jaw 14 pivots about pin 17, as allowed by camming surface 10*b*, until the jaws have sufficient clearance about the workpiece 30 to acquire a new bit. Where workpiece 30 untightening is desired, the above procedure is repeated—but after the wrench has been inverted 180°.

Importantly, and when in a fully closed position, i.e. before wrench usage, the wrench is directly slidable onto the workpiece 30 without the need for increasing the spacing of the large jaw 12 from the small jaw 14 if the wrench approaches the side of the workpiece across the flats or from the end of the workpiece in any position matching the wrench notches to the workpiece apexes. When closed, the small jaw 14 is stopped at the proper spacing for receiving the workpiece 30 by the small jaw 14 contacting both sides of the large jaw 12 at points 12*b* (see FIG. 5). Such a desirable feature for fast access to the workpiece was not accomplished by previous 30° increment advancement wrenches. The only existing wrenches that can be applied without spreading cannot "ratchet" to get a new bite every 30°.

As indicated, both large jaw 12 and small jaw 14 form an open-ended wrench, presenting box wrench type teeth, although there might be slight variations in shape and proportioning from what is illustrated. Moreover, the teeth are designed such as to aid the ratchet mechanism in releasing the workpiece 30 and, as a result, faster smoother release action is achieved. A mechanical advantage to resist spreading of the jaws is provided by two levers. The first is achieved by locating the pivot point, pin 17, of the small jaw 14 closer to the outer end of the jaw, and close to the workpiece while being farther from the point 14*a* where the small jaw 14 contacts handle 10 at 10*b*. The preferred location of pin 17 lies on a line that extends to the center of a fully inserted workpiece and forms approximately a 60° angle with a second line that extends from the center of the workpiece and through the deepest notch in the throat of the jaws being formed by the small jaw coming in close proximity to the large jaw. The second lever is provided by locating the pivot point, pin 19, of the handle 10 closer to the cam point 10*b* than the other end of the wrench where the hand is applied. The preferred location of pin 19 lies approximately on the aforementioned second line that extends from the center of the workpiece and through the deepest notch formed by the jaws. In other words, a triangular relationship exists between pivot points (17, 19) and the workpiece center point.

Spring member 20, shown in FIGS. 1, 2, 4 and 5, is typically "T" shaped in plan configuration, with the side arms 20*a* thereof being fixed into notches 12*a'* formed on the sides 12*a* of the large jaw 12. The mid-section 20*b* of the spring member 20 is positioned between portions 12*a''* along the outer edges of the large jaw sides 12*a*. In any event, the end portion of the spring member 20 lies in a "flat" 10*d* on the top (as shown) of the handle 10 to forward the small jaw 14 to a closed position.

As stated, the handle cam stop 10*c* on the cam 10*a* serves to engage the large jaw 12 and prevents the small jaw 14 from opening more than necessary to release workpiece 30 (see FIG. 1). The latter arrangement also prevents spring member 20 from becoming overstressed when the handle 10 is moved in a release direction.

In any event, and from the preceding, it should be apparent that the open-ended wrench of the invention is effective in use, as in successive movements to achieve tightening and/or untightening of a workpiece. The invention has particular adaptability, as stated, for use in limited space access conditions, where, for example, the wrench is capable of being directly placed about a workpiece from the side or end of the wrench without any flexing of the jaws for most positions of access. Moreover, the jawed head of the wrench, operative through a cam formed at an end of the handle, is readily adaptable to double-ended use, as illustrated in FIGS. 4 and 5. As to spring member 20, such is preferable in a finalized unit, but workable wrench functioning is still achievable without such.

The open-ended wrench described hereabove is susceptible to various changes within the spirit of the invention, including, by way of example, proportioning; the precise configuration of the camming surfaces on the cam in cooperation with the corresponding small jaw and large jaw surfaces; spring member 20 usage (as described); the teeth arrangement, depending upon ultimate workpiece shape and/or associated factors; modifications for various manufacturing processes, such as the large jaw being made from one or more pieces for convenience of fabrication; and, the like. Thus, the preceding should be considered illustrative and not as limiting the scope of the following claims:

I claim:

1. An open-ended ratchet wrench adapted to rotate a hexagon shaped workpiece comprising an elongated handle and cooperating small and large jaws each having flats forming notches and apexes selectively accessing flats on said hexagon shaped workpiece without spreading said small and said large jaws from a closed position in any of twelve 30° equal angled increments of access to and from the workpiece end and in any of six 60° equal angled increments of access to and from the workpiece side, where apexes formed on said hexagon shaped workpiece selectively align with a notch defined by the juncture of said small and said large jaws innermost in the resulting throat, where said large jaw, presenting bifurcated sides, in pivotally mounted near an end of said elongated handle, where said small jaw is pivotally mounted between said bifurcated sides of said large jaw, where said elongated handle has a cam disposed at said end thereof engaging a cam disposed on said small jaw and arranged approximately on a line joining the pivot points for said small and said large jaws and where said engagement is closer to said pivot point of said large jaw than to said pivot point of said small jaw, and where said small jaw pivot point, said large jaw pivot point and the center point of said hexagon shaped workpiece project the vertices of a triangle having its largest angle at said small jaw pivot point and its largest remaining angle at said hexagon shaped workpiece center point.

2. An open-ended ratchet wrench adapted to rotate a hexagon shaped workpiece comprising an elongated handle and cooperating small and large jaws each having flats forming notches and apexes selectively accessing flats on said hexagon shaped workpiece without spreading said small and said large jaws from a closed position in any of twelve 30° equal angled increments of access to and from the workpiece end and in any of six 60° equal angled increments of access to and from the workpiece side, where apexes formed on said hexagon shaped workpiece selectively align with a notch defined by the juncture of said small and said large jaws innermost in the resulting throat, where said large jaw, presenting bifurcated sides, is pivotally mounted near an end of said elongated handle, where said small jaw is pivotally mounted between said bifurcated sides of said large jaw, where said elongated handle has a cam disposed at said end thereof engaging a cam disposed on said small jaw and arranged approximately on a line joining the pivot points for said small and said large jaws and where said engagement is closer to said pivot point of said large jaw than to said pivot point of said small jaw, where said large and said small jaws are thin at the outer ends of each jaw at the first notch thereof along a straight line drawn through the center of an engaged hexagon shaped workpiece and perpendicular to the hexagon shaped workpiece axis and through each of said first notch, and where said large and said small jaws each lie within respective 120° angles extended from the center of an engaged hexagon shaped workpiece to facilitate access to said hexagon shaped workpiece when the latter is located in close proximity to an adjacent obstruction.

3. An open-ended ratchet wrench adapted to rotate a hexagon shaped workpiece comprising an elongated handle and cooperating small and large jaws each having flats forming notches and apexes selectively accessing flats on said hexagon shaped workpiece without spreading said small and said large jaws from a closed position in any of twelve 30° equal angles increments of access to and from the workpiece end and in any of six 60° equal angled increments of access to and from the workpiece side, where apexes formed on said hexagon shaped workpiece selectively align with a notch defined by the juncture of said small and said large jaws innermost in the resulting throat, where said large jaw, presenting bifurcated sides, is pivotally mounted near an end of said elongated handle, where said small jaw is pivotally mounted between said bifurcated sides of said large jaw, where said elongated handle has a cam disposed at said end thereof engaging a cam disposed on said small jaw and arranged approximately on a line joining the pivot points for said small and said large jaws and where said engagement is closer to said pivot point of said large jaw than to said pivot point of said small jaw, where said small jaw pivot point, said large jaw pivot point and the center point of said hexagon shaped workpiece project the vertices of a triangle having its largest angle at said small jaw pivot point and its largest remaining angle at said hexagon shaped workpiece center point, and where a spring member pushes against said bifurcated sides of said large jaw and said elongated handle to force said small and said large jaws towards a closed position.

4. The open-ended ratchet wrench of claim 3 where said small jaw will open from said large jaw against a tension provided by said spring member from any angle of approach when it is pressed against the flats of said hexagon shaped workpiece to envelope the maximum diameter across opposite apexes of said hexagon shaped workpiece when the rotational axes of said hexagon shaped workpiece and said small and said large jaws are parallel and move toward coincidence.

5. An open-ended ratchet wrench adapted to rotate a hexagon shaped workpiece comprising an elongated handle and cooperating small and large jaws each having flats forming notches and apexes selectively accessing flats on said hexagon shaped workpiece without spreading said small and said large jaws from a closed position in any of twelve 30° equal angled increments of access to and from the workpiece end and in any of six 60° equal angled increments of access to and from the workpiece side, where apexes formed on said hexagon shaped workpiece selectively align with a notch defined by the juncture of said small and said large jaws innermost in the resulting throat, where said large jaw, presenting bifurcated sides, is pivotally mounted near an end of said elongated handle, where said small jaw is pivotally mounted between said bifurcated sides of said large jaw, where said elongated handle has a cam disposed at said end thereof engaging a cam disposed on said small jaw and arranged approximately on a line joining the pivot points for said small and said large jaws and where said engagement is closer to said pivot point of said large jaw than to said pivot point of said small jaw, where a spring member pushes against said bifurcated sides of said large jaw and said elongated handle to force said small and said large jaws towards a closed position, and where a cam stop on said elongated handle is arranged in a stopping relationship with a cam on said large jaw at maximum opening of said small and said large jaw.

6. An open-ended ratchet wrench adapted to rotate a hexagon shaped workpiece comprising an elongated handle and cooperating small and large jaws each having flats forming notches and apexes selectively accessing flats on said hexagon shaped workpiece without spreading said small and said large jaws from a closed position in any of twelve 30° equal angled increments of access to and from the workpiece end and in any of six 60° equal angled increments of access to and from the workpiece side, where apexes formed on said hexagon shaped workpiece selectively align with a notch defined by the juncture of said small and said large jaws innermost in the resulting throat, where said large jaw, presenting bifurcated sides, is pivotally mounted near an end of said elongated handle, where said small jaw is pivotally mounted between said bifurcated sides of said large jaw, where said elongated handle has a cam disposed at said end thereof engaging a cam disposed on said small jaw and arranged approximately on a line joining the pivot points for said small and said large jaws and where said engagement is closer to said pivot point of said large jaw than to said pivot point of said small jaw, where a spring member pushes against said bifurcated sides of said large jaw and said elongated handle to force said small and said large jaws towards a closed position, where a cam stop on said elongated handle is arranged in a stopping relationship with a cam on said large jaw at maximum opening of said small and said large jaws, and where said cam stop on said elongated handle and said cam on said large jaw serve to limit strain on said spring member at the maximum opening of said large and said small jaws.

7. The open-ended ratchet wrench of claim 5 where said spring member overlies in a sealing relationship against foreign contaminants the only entry to said cam stop on said elongated handle, said cam on said small jaw, and said cam on said large jaw.

8. The open-ended ratchet wrench of claim 1 where said small jaw slides between said bifurcated sides of said large jaw until a thicker portion of said small jaw is stopped against said bifurcated sides of said large jaw proximate said notch defined by the juncture of said small and said large jaws.

9. The open-ended ratchet wrench of claim 1 where inverting such 180° selectively achieves reversal of movement of said hexagon shaped workpiece.

10. The open-ended ratchet wrench of claim 3 where ratcheting said elongated handle against the tension of said spring member permits the sliding of said flats of said small and said large jaws on said flats of said hexagon shaped workpiece and forces said small and said large jaws to remain open until said small and said large jaws close on successive flats on said hexagon shaped workpiece in preselected increments.

11. The open-ended ratchet wrench of claim 1 where a small jaw, a large jaw and a cam on said elongated handle are arranged in close proximity to each end of said elongated handle and serve selective double-ended wrench usage.

* * * * *